United States Patent [19]

Harris

[11] 4,079,991

[45] Mar. 21, 1978

[54] ROCKERS

[75] Inventor: Ben Harris, Montreal, Canada

[73] Assignee: Jack Harris, Montreal, Canada; a part interest

[21] Appl. No.: 783,620

[22] Filed: Apr. 1, 1977

Related U.S. Application Data

[63] Continuation-in-part of Ser. No. 740,973, Nov. 11, 1976, abandoned.

[51] Int. Cl.[2] ..... A47C 3/029

[52] U.S. Cl. ..... 297/133; 297/272

[58] Field of Search ..... 297/133, 272; 5/107

[56] References Cited

U.S. PATENT DOCUMENTS

| | | | |
|---|---|---|---|
| D. 142,512 | 10/1945 | Cronk | 297/133 X |
| 751,409 | 2/1904 | Pond | 5/107 |
| 1,135,266 | 4/1915 | Desper | 297/272 |
| 2,535,212 | 12/1950 | Johnson | 297/133 X |

FOREIGN PATENT DOCUMENTS

| | | | |
|---|---|---|---|
| 422,253 | 4/1967 | Switzerland | 297/272 |

*Primary Examiner*—Francis K. Zugel

*Attorney, Agent, or Firm*—Diller, Brown, Ramik & Wight

[57] ABSTRACT

This invention relates to rockers for mounting on the legs of chairs to convert the chairs to rocking chairs. The rockers are adaptable to be mounted on chairs having different spacings between the legs thereof, and to be mounted on chairs the bottoms of whose legs are connected by bars. The rockers are also adapted to be releasably or permanently mounted on the chairs. To fulfill all these functions, the inventive rocker, which consists of an arcuately shaped elongated member, has elongated openings adjacent the front and rear ends and on the top surface thereof. The elongated openings receive the legs of normal chairs. Extending across the width of the rocker, and over the elongated openings, are grooves which can receive the bars of chairs whose legs are connected by bars. As the openings are elongated the rockers can be mounted on chairs with different lengths of spacing between their front and rear legs. As chairs with bars are usually of the folding type, the chairs can be folded to fit the spacing between grooves. However, two grooves can also be provided at the rear of the rocker so that the rocker will fit a wider range of such chairs.

4 Claims, 7 Drawing Figures

ROCKERS

CROSS-REFERENCE TO RELATED APPLICATIONS

This application is a Continuation-In-Part application of application Ser. No. 740,973, filed Nov. 11, 1976 now abandoned.

BACKGROUND OF THE INVENTION

1. Field of the Invention

This invention relates to rockers for mounting on the legs of chairs to convert the chairs to rocking chairs. More specifically, the invention relates to such rockers which are adaptable to be mounted on chairs whose legs have different spacing dimensions, and also for mounting on chairs of folding type chairs which have a bar extending between the back legs and a separate bar extending between the front legs thereof.

2. Description of the Prior Art

It is known to provide rockers which are adaptable to be mounted on chairs whose front legs are spaced from the back legs thereof by different amounts of space. Thus, as shown in U.S. Pat. No. 1,566,157, Michaelson, issued Dec. 15, 1925, the back leg of a chair is received in an elongated opening closer to the rear end of the rocker. Discrete openings are provided at the front end of the rocker for receiving the front end of a chair. However, Michaelson teaches only rockers which are permanently mounted on the chairs. Michaelson does not contemplate such rockers which are releasably mounted on the chair.

U.S. Pat. No. 101,802, Zahrzewska, patented Apr. 12, 1870, teaches a rocker which is releasably mounted on a chair. Zahrzewska uses flexible means, such as a strap or cord, for releasably mounting the rockers on a chair. However, the Zahrzewska patent cannot accept chairs of the folding type whose front legs are joined by a bar and whose rear legs are joined by a separate bar.

Other examples of rockers which can be mounted on chairs whose legs have different size spacings are shown in U.S. Pat. Nos. 145,036, Wilcox et al, issued Nov. 25, 1873, 264,917, Andrews, issued Sept. 26, 1882, 1,367,390, Hinson, issued Feb. 1, 1921, 1,682,685, Rodery, issued Aug. 28, 1928. All of these rockers suffer from the lack of either being adapted to be mounted only permanently, or not being able to accept folding type chairs.

SUMMARY OF THE INVENTION

It is therefore an object of the invention to provide rockers which are adaptable to receive either chairs of the ordinary type, or chairs having their front legs joined by a bar and their back legs joined by a separate bar.

It is a further object of the invention to provide such rockers which can be either permanently mounted on the chair or which can be releasably mounted on the chair.

In accordance with the invention, rockers for attachment to chairs having front legs and rear legs, each comprise: an arcuately shaped alongated member having a length, a width, a top surface, a bottom surface, said top and bottom surfaces joined by side surfaces, a front end and a rear end; said bottom surface being bow-shaped to define a rocking surface; a front portion on said top surface at said front end having a longitudinally extending elongated opening in the top surface thereof; a rear portion on said top surface at said rear end having a longitudinally extending elongated opening in the top surface thereof; at least one groove across the width of said rocker in said front portion and over said elongated opening in said front portion; and at least one groove across the width of said rocker in said rear portion and over said elongated opening in said rear portion; each of said grooves being, in accordance with the invention, substantially semicircular in cross-section. Preferably, two parallel grooves are provided in said rear portion, both said parallel grooves extending across the width of said rocker and over the elongated opening in said rear portion.

The rocker may also comrpise means, at said front end and at said rear end, for securing said rocker to legs of a chair, either permanently or releasably.

In a further embodiment, rockers for mounting on chairs having a set of front legs and a set of rear legs, the set of front legs being connected to each other by a first transverse horizontal cylindrical front member, and the rear legs being connected to each other by a second transverse horizontal cylindrical rear member, each said rocker comprises: an arcuately shaped elongated member having a length, a width, a top surface, a bottom surface, said top and bottom surfaces joined by side surfaces, a front end and a rear end; said bottom surface being bow-shaped to define a rocking surface; a front portion on said top surface at said front end having at least one groove extending across the width of said rocker in said front portion; and a rear portion on said top surface at said rear end having at least one groove extending across the width of said rocker in said rear portion; characterized in that said groove defines, in cross-section, an arc of a circle which arc is greater than a semicircle.

A slit may be disposed forward of said groove in said front portion, the slit having a shape corresponding substantially to the front part of the cross-section of said groove; and a slit may be disposed rearward of each groove in the rear portion, each said slit having a shape corresponding substantially to the rear part of the cross-section of its respective groove.

In a still further embodiment, each said groove comprises a double layered groove; the top layer adjacent the respective top surface of said rocker comprising a groove whose cross-section has an arc of a circle having a first diameter; the second layer comprising a groove whose cross-section has an arc of a circle of a second diameter; the first diameter being greater than the second diameter; and the center of each top circle being vertically in line with the center of its respective bottom circle.

BRIEF DESCRIPTION OF THE DRAWINGS

The invention will be better understood by an examination of the following description together with the accompanying drawings in which.

DETAILED DESCRIPTION OF THE DRAWINGS

Figure 1:
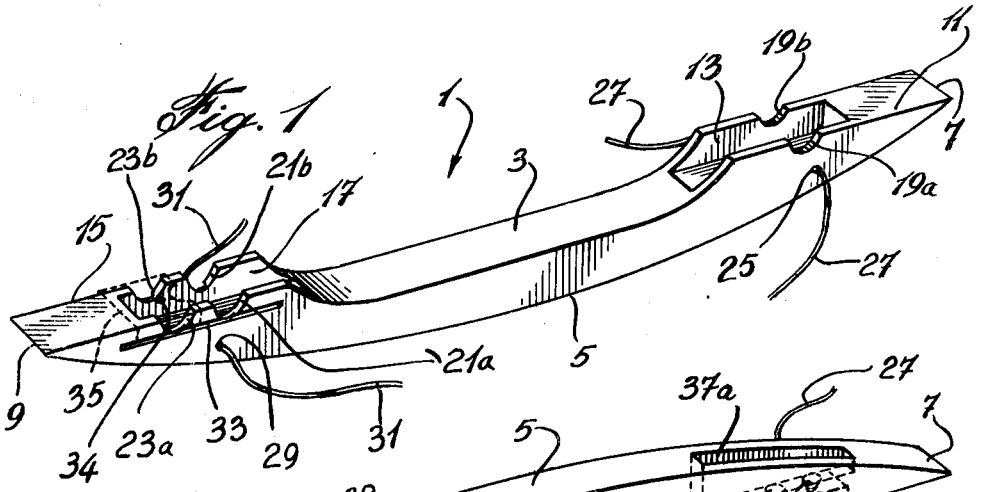
FIG. 1 is a perspective view of the inventive rocker top side up.

Referring now to FIG. 1, the rocker, indicated generally at 1, comprises a top surface 3, a bottom surface 5, a forward end 7, and a rear end 9. Disposed at the top surface of the front end is a front portion 11 having a longitudinally extending elongated opening 13 in the top surface thereof. The elongated opening 13 is of a width great enough to receive the legs of most ordinary four legged chairs.

Disposed on the top surface at the rear end of the rocker is a rear portion 15 having a longitudinally extending elongated opening 17 disposed therein. The width of 17 is also great enough to receive the rear legs of four legged chairs.

Extending across the width of the rocker in the front portion is a groove formed by aligned groove portions 19*a* and 19*b* which are substantially semicircular in cross-section. This groove can receive bars of chairs whose front legs are joined by such bars. A similar groove, consisting of aligned groove portions 21*a* and 21*b*, is included in the rear portion 15. In order to provide a measure of adjustability relative to folding type chairs, a second groove, consisting of the parts 23*a* and 23*b*, is also included in the rear portion. Groove portions 21*a*, 21*b*, 23*a* and 23*b* are also substantially semicircular in cross-section.

For releasably securing the rocker to the legs of a chair on which it is mounted, an opening 25 is provided across the width at the front end of the rocker, and a flexible means, such as cord means or a strap means, 27, extends through the opening and out of both ends thereof. Similarly, an opening 29 is included in the rear end of the rocker, and a flexible means 31 extends through the opening 29 and out of both ends thereof. The flexible means is tied around the front and rear legs as will be seen in considering FIGS. 3 and 4 hereof.

Figure 2:
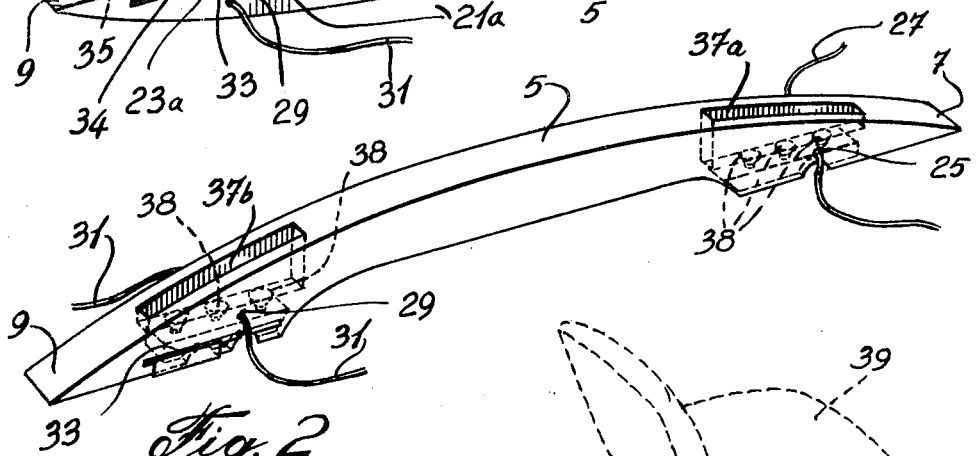
FIG. 2 is a perspective view of the inventive rocker bottom side up.

In order to permanently secure the rockers to the legs of a chair, channels 37*a* and 37*b* are provided in the front and rear ends respectively on the bottom surface 5 of the rocker as can be seen in FIG. 2. Channel 37*a* is centered on the bottom surface directly beneath the elongated opening 13 and is co-extensive therewith, and channel 37*b* is centered on the bottom surface directly beneath elongated opening 17 and is co-extensive therewith.

Figure 3:
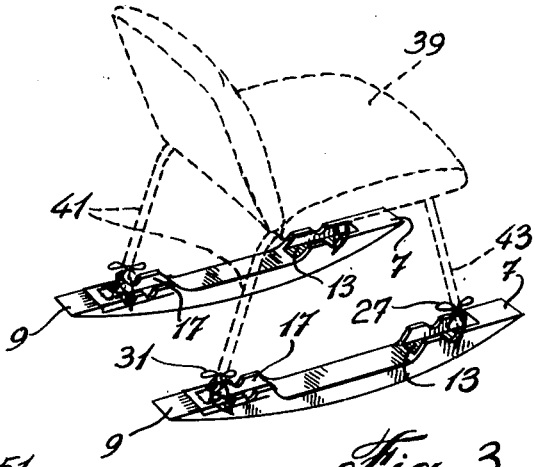
FIG. 3 shows how the inventive rockers are mounted on ordinary chairs.
Figure 4:
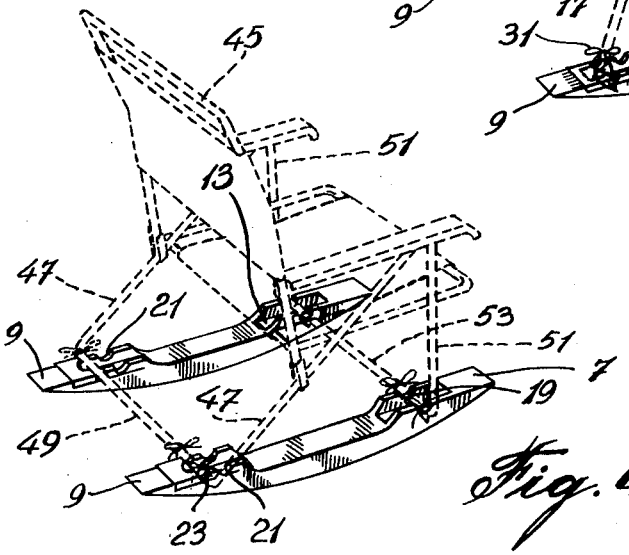
FIG. 4 illustrates how the inventive rockers are mounted on folding type chairs with bars connecting the legs thereof.

In order to illustrate how the inventive rockers are mounted on chairs, reference is had to FIGS. 3 and 4 hereof. Referring first to FIG. 3, the rockers are mounted on a chair 39 having rear legs 41 and front legs 43. As can be seen, each rear leg is mounted in a respective rear elongated opening 17, and each front leg 43 is mounted in a respective front elongated opening 13. For releasable securing, the flexible means 27 and 31 are wrapped around the front and rear legs respectively and then knotted to secure the respective legs in place. For permanently mounting the rockers on the chairs, screws would be inserted through the channel 37*a* screwed through the rocker and into the elongated opening 13 and thence into the frong leg 43 of the chair. Similarly, a screw would be inserted throgh the rear channel 37*b* and screwed into the rear leg 41 of the chair. The channels 37*a* and 37*b* ensure that the screw heads do not protrude beyond the bottom surface of the rocker, which, as can be seen in FIGS. 1 and 2, is bow-shaped to define a rocking surface. In addition, a series of holes 38 can be provided between the channels and the respective elongated openings for receiving the screws. The top of each opening can be flared to receive screws with tapered heads.

FIG. 4 shows how a folding type chair 45, having rear legs 57 connected by a transversely extending bar 49 and front legs 51 connected by a transversely extending bar 53, can be received by the inventive rockers. As can be seen in FIG. 4, the bar 53 is received in the grooves 19 of both rockers, while the bar 49 is received in groove 23 at the rear of both rockers. As will be appreciated, if the distance between bars 49 and 53 is less than that shown in the drawing, then the bar 49 will be inserted in the groove 21 instead.

Once again, the flexible means will be wrapped around the bar or the legs and knotted to secure the rocker to the chair. For permanent attachment, a screw would again be used through the channels 37*a* and 37*b*. As the bars are normally made of a metallic material, it will be necessary to use metal screws for this purpose.

Returning to FIGS. 1 and 2, for providing greater security of the rear legs, movable means 35 are slidable in channels 33 in the side walls at the rear end of the rockers. The means 35 includes an opening 34 in the top surface thereof, and this opening 34 is great enough to receive a screw. The means 35 would then be slid up against the leg, and a screw would be inserted through the opening 34 to retain the means 35 in place.

In the embodiments illustrated in FIGS. 1 to 4, special means are required for securing the legs of a chair to the rocker. Specifically, in considering the type of chair illustrated in FIG. 4, the transversely extending bar has to be tied down with strings 31 shown in FIGS. 1 and 2. This type of arrangement provides a certain amount of inconvenience, and unless the string is well tied, it is possible that the chair will work loose or that the string will get untied and the chair will be completely removed from the rockers.

Figure 5:
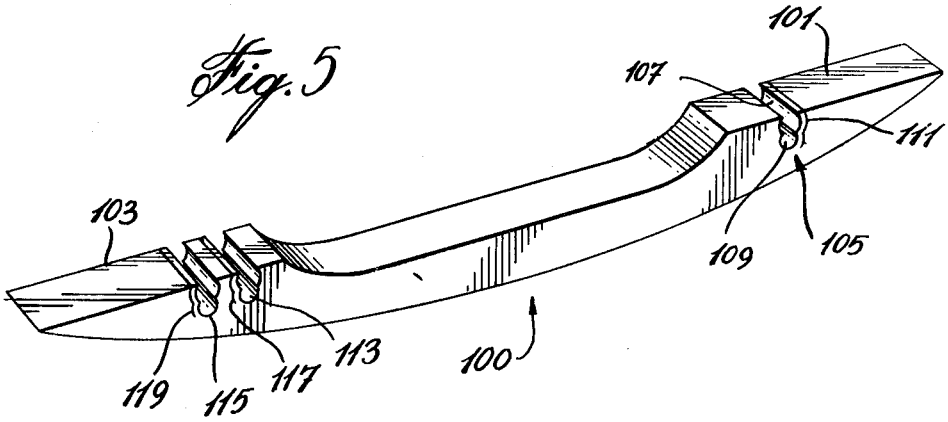
FIG. 5 illustrates a second embodiment of the invention using snap-in grooves.
Figure 6:
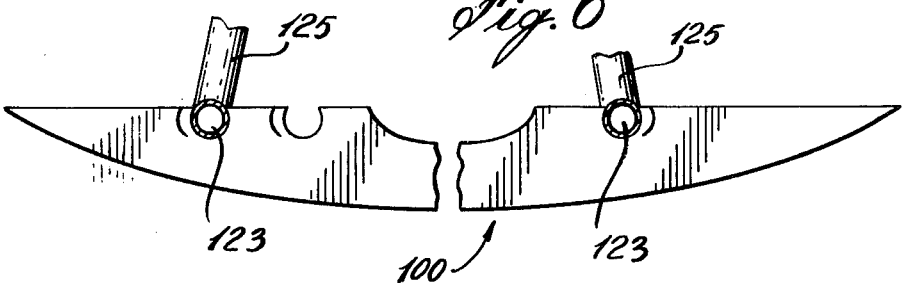
FIG. 6 is a side view illustrating how a single layered snap-in groove operates.
Figure 7:
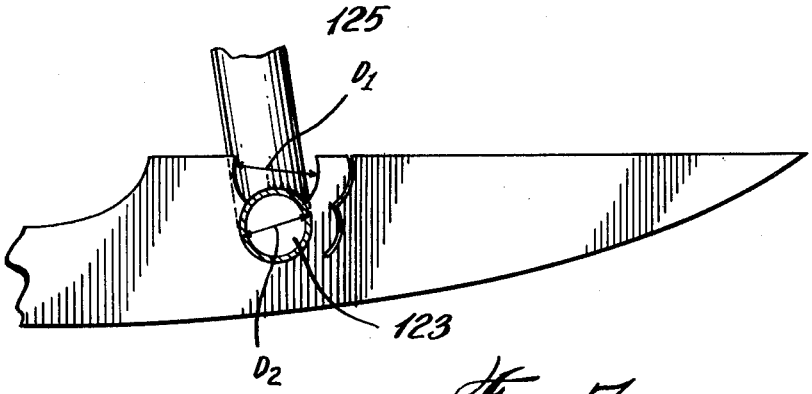
FIG. 7 is a side view illustrating how a double layered snap-in groove operates.

To overcome the above problem, a further embodiment is illustrated in FIGS. 5 to 7 hereof in which it is possible to "snap-in" the horizontal bar into the grooves. The reason that it is necessary to tie down the horizontal bar in the FIGS. 1 and 2 embodiment is because the grooves 19, 21 and 23 are only substantially semicircular in cross-section. In contradistinction, in the embodiments illustrated in FIGS. 5 to 7, the cross-section of each groove defines an arc which is greater than a semicircle.

Referring now to FIGS. 5 to 7, each rocker 100 again includes a front portion 101 and a rear portion 103. Groove arrangement 105 is disposed in the front portion. The groove arrangement 105 includes a two layered groove having a top layer groove 107 and a bottom layeer groove 109. The top layer 107 defines an arc of a circle greater than a semicircle which circle has a diameter D1. In a like manner, the bottom layer groove 109 defines an arc of a circle greater than a semicircle having a diameter D2. As can be plainly seen, the diameter D1 is greater than the diameter D2. In addition, the center of the top circle is vertically in line with the center of the bottom circle.

Disposed forwardly of the groove arrangement 105 is a sot 111 whose purpose will be explained below.

In a like manner, the rear portion includes a groove arrangement 113, also having a double layered groove, and a groove arrangement 115 also having a double layered groove. Disposed rearwardly of each groove are slits 117 and 119 respectively.

In the embodiments illustrated in FIG. 5, the top arrangement will be used with a chair whose transverse section is cylindrical in cross-section and has a diameter equal to D1. The bottom layer will accommodate such a horizontal bar having a diameter D2.

Although a double layered groove is illustrated in FIG. 5, it will be appreciated that only a single layered groove could also be provided as shown in FIG. 6. Considering FIG. 6, the groove 121 which forms an arc of a circle having a given diameter, will accommodate the horizontal bar of a chair 123 which has the same diameter. The horizontal bar is, of course, connected to vertical legs 125 at either end thereof (only one leg is illustrated in FIG. 6).

As will be appreciated from the description below, in order for this rocker to operate, the rocker must be made of a flexible and compressible material such as a plastic material.

In operation, the rocker as illustrated in FIGS. 5 to 7 works as follows:

Because the diameter of the horizontal bar of the chair to be used in association with the rocker is greater than the top opening of the groove, the bar will have to be forced into position in the groove. When the bar is forced downwardly, the material at either edge of the top opening of the groove will be compressed to permit passage of the bar. The slits 111, 117 and 119 are provided so that the material at the top opening of the groove can be moved into an empty space so that this material will not have to be compressed to as great a degree. However, as will be appreciated, the slits are not absolutely necessary as it is also possible to provide a material which has a great enough degree of compressibility to receive an appropriate bar.

To further illustrate how this embodiment works, we will assume that the groove 107 in FIG. 5 has a diameter of 1 inch and the groove 109 has a diameter of ¾ of an inch. If a chair having a horizontal bar ¾ of an inch in diameter is to be inserted into the FIG. 5 embodiment, then the horizontal bar will pass easily through the groove 107. It will then be forced into the groove 109 until it hits the bottom of the groove. When the bar is at the bottom of the groove, the top surface of the groove, which had been compressed while the bar was being forced through it, will snap back and lock the bar into position. The bar will then not be loose in the groove but will be locked into place and will be removable only upon application of a positive force in the upward direction.

When the chair has a bar having a 1 inch diameter, it will be necessary to force the bar into the upward groove. The top surface of the bottom groove 109 is small enough so that it will not be possible to force the 1 inch bar into the groove 109. As the widest-most portion of the bar passes through the top opening, once again, the material at the top surface will begin to conform with the shape of the narrower part of the bar. When the groove is completely conformed to the shape of the bar, the top surface will no longer be in a compressible state, and the bar will not move any further in a downwardly direction. Again, the top surface will have snappd back to hold the bar positively in place so that once again it will be removable only by application of a positive force in an upward direction.

Although not illustrated in FIGS. 5 to 7, it will of course be appreciated that elongated openings, such as 13 and 17 in FIG. 1, could also be included in the FIGS. 5 to 7 embodiment.

Although specific embodiments have been above described, this was for the purpose of describing, but not limiting, the invention. Various modifications which will come readily to the mind of one skilled in the art, are within the scope of the invention as defined in the appended claims.

I claim:

1. Rockers for mounting on chairs having a set of front legs and a set of rear legs, the set of front legs being connected to each other by a first transverse horizontal cylindrical front member, and the rear legs being connected to each other by a second transverse horizontal cylindrical rear member, each said rocker comprising:

an arcuately shaped elongated member having a length, a width, a top surface, a bottom surface, said top and bottom surfaces joined by side surfaces, a front end and a rear end;

said bottom surface being bow-shaped to define a rocking surface;

a front portion on said top surface at said front end having at least one groove extending across the width of said rocker in said front portion; and a rear portion on said top surface at said rear end having at least one groove extending across the width of said rocker in said rear portion;

characterized in that said groove defines, in cross-section, an arc of a circle, which arc is greater than a semicircle.

2. A rocker as defined in claim 1 and comprising two parallel grooves in said rear portion, both said parallel grooves extending across the width of said rocker.

3. A rocker as defined in claim 2 and comprising a slit forward of said groove in said front portion, the slit having a shape corresponding substantially to the front part of the cross-section of said groove; and a slit rearward of each groove in the rear portion, each said slit having a shape corresponding substantially to the rear part of the cross-section of its respective groove.

4. A rocker as defined in claim 3 wherein each said groove comprises a double layered groove;

the top layer adjacent the respective top surface of said rocker comprising a groove whose cross-section has an arc of a circle having a first diameter;

the second layer comprising a groove whose cross-section has an arc of a circle of a second diameter;

the first diameter being greater than the second diameter; and the center of each top circle being vertically in line with the center of its respective bottom circle.

* * * * *